US005308195A

United States Patent [19]

Hotek

[11] Patent Number: 5,308,195

[45] Date of Patent: May 3, 1994

[54] COPING CONSTRUCTION FOR A RETAINING WALL

[75] Inventor: Dan J. Hotek, Chantilly, Va.

[73] Assignee: The Reinforced Earth Company, Vienna, Va.

[21] Appl. No.: 17,645

[22] Filed: Feb. 12, 1993

[51] Int. Cl.[5] ..... E02D 29/02

[52] U.S. Cl. ..... 405/284; 405/287

[58] Field of Search ..... 405/31, 262, 284, 286, 405/287, 287.1

[56] References Cited

U.S. PATENT DOCUMENTS

| | | | |
|---|---|---|---|
| 1,006,247 | 10/1911 | Martin | 405/287 |
| 4,045,965 | 9/1977 | Vidal | 405/287 |
| 4,260,296 | 4/1981 | Hilfiker | 405/284 |
| 4,494,892 | 1/1985 | Wojciechowski | 405/286 X |
| 4,911,585 | 3/1990 | Vidal et al. | 405/287 |

*Primary Examiner*—David H. Corbin

*Attorney, Agent, or Firm*—Allegretti & Witcoff, Ltd.

[57] ABSTRACT

An improved coping construction is comprised of a precast element attached to a retaining wall. The retaining wall and precast element serve as a portion of the form for a cast in place portion of the coping construction.

8 Claims, 2 Drawing Sheets

Fig. 1
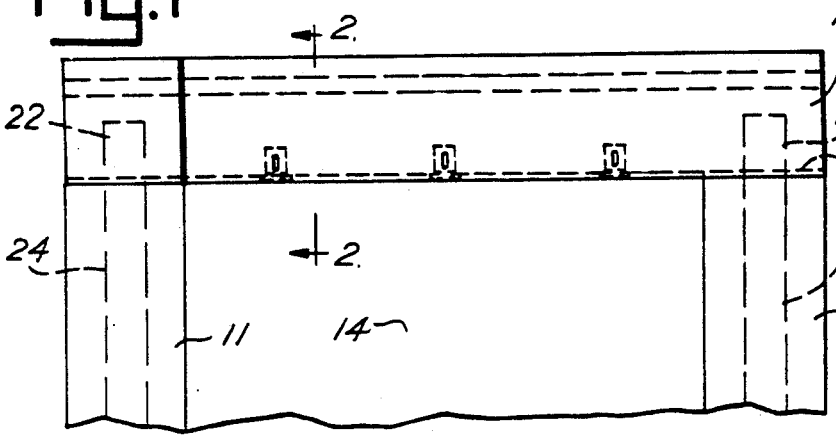
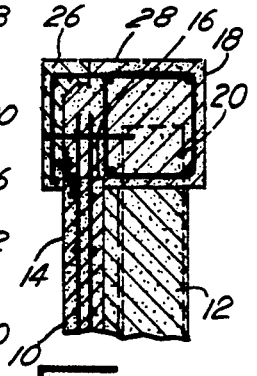
Fig. 2
Fig. 3
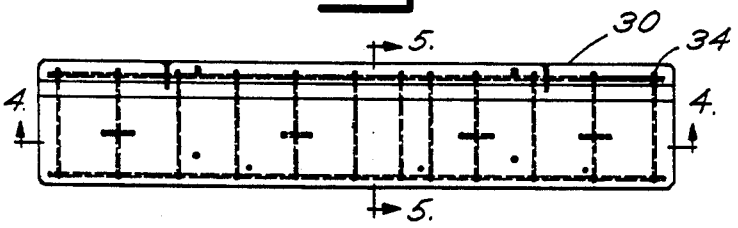
Fig. 5
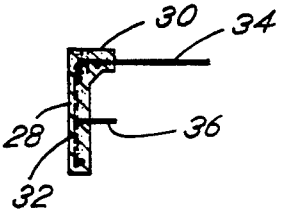
Fig. 4
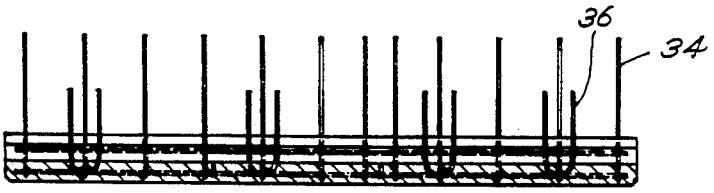
Fig. 6
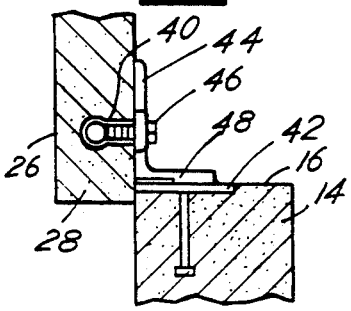
Fig. 7
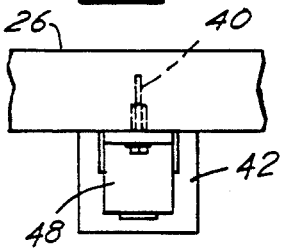
Fig 8
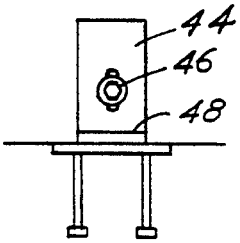

COPING CONSTRUCTION FOR A RETAINING WALL

BACKGROUND OF THE INVENTION

This invention relates to an improved coping construction for a retaining wall or the like.

Often it is appropriate and necessary to provide a specially shaped coping along the top edge of a retaining wall for example. Typically retaining walls may be formed from precast elements or they may be cast in place. Additionally, retaining walls may be constructed by a combination of cast in place as well as precast elements. In any event, a retaining wall such as a vertical retaining wall often needs a specially shaped or formed coping along the top edge of the wall.

Often a coping is cast in place monolithically as part of the construction of a cast in place wall for a partial cast in place wall. Alternatively, the coping may be cast in place on top of a wall formed by precast elements. Also, the coping may be comprised of precast elements positioned along the top edge of a wall.

Certain projects now require that the coping employ a decorative color or facing. For example, it may be necessary to provide a coping made from white cement concrete as contrasted with a grey cement concrete wall. The cost of a full coping constructed from white cement concrete is excessive and thus there has also developed a need to provide a coping wherein the facing of the coping may be made from special concrete materials whereas the remainder of the coping may be constructed from a less expensive concrete. These needs among others led to the development of the present invention.

SUMMARY OF THE INVENTION

In a principal aspect, the present invention comprises a partial precast coping element which may be fabricated from a particular type of concrete or cement having a particular, desired composition, color or the like. The coping element is precast and has reinforcing bars therein which form an internal lattice and which project therefrom. The partial precast coping element includes a generally planar facing section with the bars projecting from the backside thereof. This precast coping element may then be attached to the top of a retaining wall to define a part of a form or mold for the remainder of the cast in place coping. The remainder of a form is placed against the retaining wall and is spaced from the partial precast coping element to define a complete form or mold into which is poured the cast in place concrete material thereby completing the formation of the full coping. Reinforcing bars preferably project from the retaining wall into the cast in place element of the coping. Additional reinforcing bars may be added during the construction process. Further, an attachment bracket may be utilized to appropriately align and retain the precast coping element on the retaining wall. The retaining wall itself may be formed of precast elements in whole or in part, or alternatively may be a cast in place. The method of assembly or construction of the coping provides that the precast coping element defines, at least in part, in combination with the retaining wall, the form or mold for the cast in place coping element.

Thus, it is an object of the invention to provide an improved coping construction.

A further object of the invention is to provide an improved coping construction comprised, in part, of a precast coping element.

Yet a further object of the invention is to provide a partially precast coping element which may be used in combination with a retaining wall to provide a coping having a physical appearance which is aesthetic or otherwise distinct from the retaining wall and/or the cast in place coping element of the coping construction.

Yet another object of the invention is to provide a method for construction of a coping comprised of a precast coping element and a cast in place coping element.

These and other objects, advantages and features of the invention will be set forth in the detailed description which follows.

BRIEF DESCRIPTION OF THE DRAWING

In the detailed description which follows, reference will be made to the drawing comprised of the following Figures:

FIG. 1 is a front elevation of the improved coping of the present invention in combination with a retaining wall formed of precast as well as cast in place elements;

FIG. 2 is a side cross sectional view of the construction of FIG. 1;

FIG. 3 is a back side elevation of the partial precast coping element utilized in the construction of the retaining wall and coping depicted in FIG. 1;

FIG. 4 is a section of the precast coping element taken along the line 4—4 in FIG. 3;

FIG. 5 is a section taken along the line 5—5 in FIG. 3;

FIG. 6 is an enlarged sectional view of the bracket for attaching the precast coping to the vertical retaining wall;

FIG. 7 is a plan view of the coping and wall depicted in FIG. 6;

FIG. 8 is an assembly detail and elevation of the coping and retaining wall shown in FIG. 6;

Figure 9:
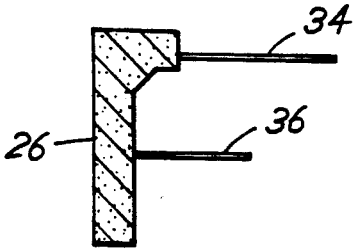
Figure 10:
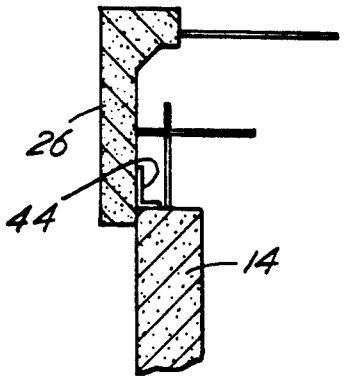
Figure 11:
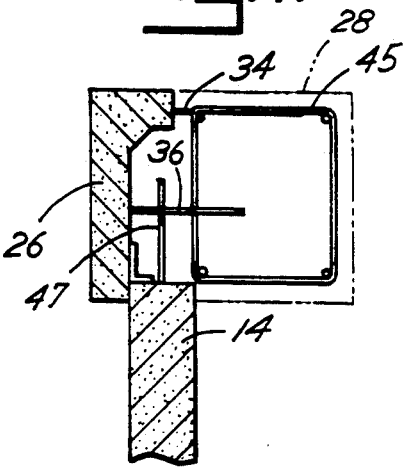
Figure 12:
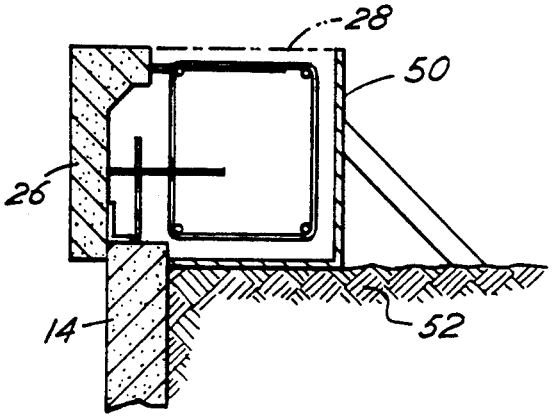
Figure 13:
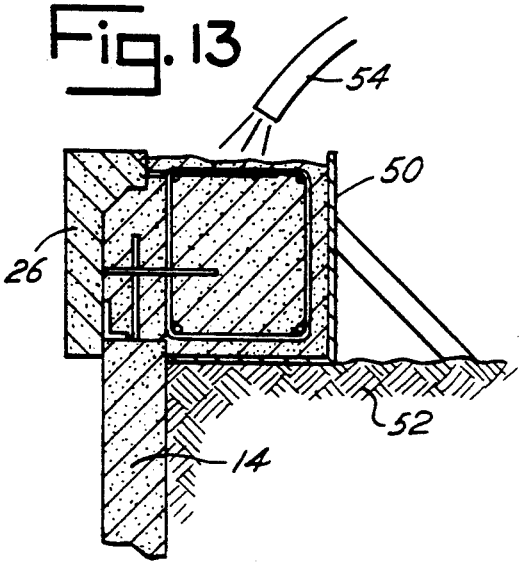
Figure 14:
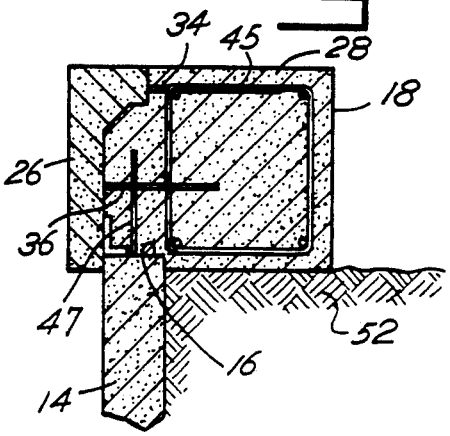

Beginning with FIG. 9 there is depicted the series of steps utilized in the erection of a coping of the type depicted on the wall in FIG. 1. Thus, FIG. 9 comprises a schematic sectional view of the precast coping element utilized in the practice of the invention;

FIG. 10 illustrates the next step in the assembly of the precast coping element to the retaining wall;

FIG. 11 illustrates the next step wherein reinforcing bars are placed in position with respect to the precast coping element and the retaining wall;

FIG. 12 illustrates a further step wherein a form is positioned in conjunction with the retaining wall and precast coping element;

FIG. 13 illustrates the further step of casting the cast in place element of the coping; and FIG. 14 illustrates the resultant cast in place and precast coping supported on a retaining wall element as also depicted in FIG. 2.

DESCRIPTION OF THE PREFERRED EMBODIMENT

The present invention constitutes an improved coping construction for a retaining wall and a method for manufacture or erection of such a coping construction. The coping construction of the invention may be used in combination with a retaining wall comprised of precast panels as well as a retaining wall wherein the wall itself is cast in place or comprised of cast in place parts or panels in combination with precast parts or panels. Additionally, the coping construction of the invention as well as the construction method associated therewith may be utilized in combination with structure other than retaining walls. In other words, the coping construction of the invention may be utilized in combination with a variety of cast in place or precast constructions which require a complete coping having a special color, configuration, material or the like.

Referring to FIG. 1, there is illustrated a plan view of the front face of a typical retaining wall in combination with the improved coping construction of the invention. The retaining wall of FIG. 1 is comprised of a cast in place beam 10 which is cast over or adjacent a vertical steel channel 12. In the embodiment depicted in FIG. 1 the retaining wall is illustrated as a wall comprised of a first cast in place beam 10 and a second cast in place beam 11 spaced from the first beam 10. A precast panel 14 is retained by and positioned between the cast in place beams 10 and 11. The combination of the cast in place beams 10 and 11, as well as the precast panel 14 define a retaining wall top surface 16.

The coping construction of the present invention, namely coping construction 18 is supported generally on top of the surface 16 and is constructed in the manner which will be described below. It should be noted that in the particular embodiment depicted the channel 12 associated with the cast in place beam 10 projects above the surface 16 and into the final coping 18. Thus the top end 20 of channel 12 is embedded in the coping 18. Similarly the top end 22 of a channel 24 is retained or embedded within the final coping 18.

Referring next to FIG. 2 there is illustrated in a side section view the combination of the present invention. The cast in place beam 10 and precast panel 14 define the top surface 16. The total coping construction 18 is defined by a first precast element 26 and a second cast in place element 28. It will be noted that the cast in place element 28 incorporates the top end 20 of channel 12.

Reference is next directed to FIGS. 3, 4 and 5 which depict in further detail the precast coping element 26. Referring to those Figures, the precast element 26 is comprised of a front face section 28 and a transverse top section 30. Reinforcing bars 32 form a lattice within the concrete front face section 28. Erection anchor reinforcing bars 34 project from the precast element 26 and more particularly, from the transverse section 30. Additional reinforcing bars 36 project from the back side at the center of the front panel section 28. The material which is used to precast the element 26 may be colored concrete, for example a white cement concrete. Other decorative or colored cement or other precast material may be used to make the precast coping element 26. Important features of the precast element 26 are the reinforcing bars which project therefrom and the dimensions of the element 26 since those dimensions and the element 26 itself will define a part of the form associated with the cast in place element 28 of the coping construction.

FIGS. 6, 7 and 8 illustrate a typical arrangement for connection of the precast coping element 26 to a retaining wall panel 14 and/or cast in place beam 12. Thus, referring to those Figures, the precast coping element 26 includes a ferrule insert or similar component 40 for receipt of an anchor bolt 46. The precast panel 14 is cast with embedment plate 42 retained on the top surface 16 as depicted, for example, in FIGS. 6 and 8. An angle plate 44 having an L shape is attached to the precast coping element 26 by means of a bolt 46. The horizontal run 48 of the angle plate 44 is welded to the embedment plate 42 so that the vertical element 28 of the coping element 26 overlays or overlaps the top edge of the panel 14 and the surface 16. The coping element 26 is also held tightly against the front face of the panel 14. In this manner as depicted in FIG. 2, the precast coping element 26 defines, at least in part, the form for the cast in place element 28 of the coping 18.

FIGS. 9 through 14 illustrate in greater detail the method of construction associated with the coping element 26 and the retaining wall associated therewith so as to construct a complete coping 18 comprised of a precast element 26 and the cast in place element 28. First it should be noted that the precast element 26 has a finite length and thus a series of such elements 26 would be affixed and positioned along the top edge of retaining wall 14 in a manner depicted in FIG. 1. The joints between each of the adjacent coping elements 26 should be appropriately sealed with respect to each other. Additionally, the joint between the precast coping element 26 and the precast panel 14 defined by the retaining wall 14 should also be appropriately sealed.

Referring to FIG. 9 the method of the invention contemplates having a series of precast coping elements 26 available with their reinforcing bars 34, 36 projecting in a manner so as to provide reinforcement with respect to the cast in place element 28.

FIG. 10 illustrates the next step in the construction phase. The coping element 26 is positioned on the retaining wall 14 by means of the anchor 44 as previously described. Subsequently as shown in FIG. 11, reinforcing bars 45 are added in a lattice work connected to the reinforcing bars 34, 36 projecting from element 26. It should be noted that reinforcing bars 47 preferably are provided and project upwardly from the retaining wall or panel 14. The reinforcing bars 47 are thus positioned within the region defined by the dotted lines in FIG. 11 which region contemplates the cast in place element 28 of the coping.

FIG. 12 illustrates the next step in the construction phase. There a form 50 is positioned to define the cast in place element 28 of the coping 18 in combination with the precast element 26 and wall panel 14. It is noted that the wall panel 14 comprises part of a retaining wall constructed to support or retain backfill 52. The form 50 may thus define both the side and bottom of the coping construction 18. Alternatively, the form 50 may define only the backside thereof and the fill 52 will define the bottom of the cast in place portion or element 28 of the coping construction 18.

FIG. 13 then illustrates the next step in the construction of the coping 18. Concrete is from a source such as a ready mix source is directed appropriately, for example down a slide 54, into the mold or form created by the precast coping element 26, wall 14 and the form 50. In this manner, the reinforcing bars 34, 36, 45, 47 are enveloped in the concrete. Note importantly that the wall element, in this case, the surface 16 of precast element 14 also defines a portion of the form for the cast in place construction. Thus, a precast coping element 26 and the wall 14 as well as the form 50 in combination define a cast in place mold or form for the cast in place coping element 28. As a final step, the form 50 is removed to reveal the construction as depicted in FIG. 14 which is substantially the same as the construction illustrated in FIG. 2.

It is appropriate to provide for variations with respect to the described construction and method. The specific shape of the precast coping element 26 may be varied significantly as may the manner of construction and elements associated with the retaining wall. Additionally, the reinforcing bar configuration may be varied significantly. The cast in place configuration of the coping construction may also be configured in many different ways. Among those ways the cast in place portion may be designed as a road traffic barrier for directing traffic in a manner considered appropriate by highway engineers. It is also possible to utilize multiple precast cladding elements as forms for the final coping construction. The elements may be arranged vertically adjacent or in opposed relation to define various other parts of the mold for the cast in place element of the coping construction. Thus, while there has been set forth a preferred embodiment of the invention, it is to be understood that the invention is limited only by the following claims and equivalents thereof.

What is claimed is:

1. A finite length partial coping construction for a retaining wall, said partial coping construction comprising in combination:

a plurality of reinforcing bars forming a finite length lattice for said partial precast coping construction, said bars defining a generally upright planar facing section for the partial precast coping construction, said lattice having a top and a center;

a plurality of transverse reinforcing bars projecting outwardly from the top and center of the facing section;

precast cast material encapsulating the lattice and at least a portion of the top projecting reinforcing bars to define a planar front facing surface and an upper edge so that the plurality of transverse reinforcing bars project from the precast material away from the front surface; and an upper transverse section of precast material extending from the facing section at the upper edge in the same general direction as the top transverse reinforcing bars, the finite length coping construction being constructed to comprise only one side of a coping and being cooperative with cast in place material as the other side of the coping whereby the entire coping is comprised of at least two parts, which may be of distinctive materials, but both of which comprise in combination a generally equal elevation coping for a retaining wall.

2. The partial coping construction of claim 1 in combination with a linear array of said partial coping constructions, and a cast in place element along the length of the facing section, said cast in place element extending to form a complete coping, the cast in place element encapsulating the transverse reinforcing bars the precast coping construction forming at least a part of the form for the cast in place element, said coping comprised of generally equal elevation precast and cast in place elements.

3. The combination of claim 2 wherein the projecting bars are retained in the cast in place element.

4. The combination of claim 2 further in combination with a vertical retaining wall member having a top surface, said precast coping element affixed to the retaining wall member so that the retaining wall member and partial coping construction both comprise at least a part of the form for the cast in place element along the length of the facing section.

5. The combination of claim 4 wherein the retaining wall member also includes reinforcing bars extending into the cast in place element.

6. The combination of claim 4 including means for fastening the partial coping element to the retaining wall member.

7. The combination of claim 4 wherein the retaining wall member includes a generally planar front face with an outside surface and a top edge, and wherein the facing section is placed against the outside surface of the front face adjacent the top edge.

8. A method for building a coping along the top of a retaining wall comprising the steps of:

positioning a partial precast coping element along one edge of the retaining wall to partially define a form for a cast in place element of the coping, said precast coping element including a generally planar facing section with reinforcing bars projecting therefrom over the retaining wall;

positioning the remainder of a removable form for the cast in place coping in combination with the retaining wall and partial precast coping element;

casting the cast in place element of the coping; and removing the removable form.

* * * * *